US005941620A

United States Patent [19]

Weber

[11] Patent Number: 5,941,620

[45] Date of Patent: Aug. 24, 1999

[54] CORNER FURNISHING UNIT

[75] Inventor: Peter Weber, Beinwil a. See, Switzerland

[73] Assignee: Peka-Metall AG, Switzerland

[21] Appl. No.: 08/851,372

[22] Filed: May 5, 1997

[30] Foreign Application Priority Data

May 6, 1996 [EP] European Pat. Off. ..... 96810290

[51] Int. Cl.[6] ..... A47B 81/00

[52] U.S. Cl. ..... 312/238; 312/274

[58] Field of Search ..... 312/238, 272, 312/273, 310

[56] References Cited

U.S. PATENT DOCUMENTS

| | | | |
|---|---|---|---|
| 2,735,790 | 9/1956 | Soans . | |
| 2,872,267 | 2/1959 | Machingo et al. | 312/273 |
| 3,080,326 | 3/1963 | Smith . | |
| 3,195,969 | 7/1965 | Wallen | 312/273 |
| 4,155,610 | 5/1979 | Englund . | |
| 5,518,282 | 5/1996 | Sawada . | |

FOREIGN PATENT DOCUMENTS

| | | | |
|---|---|---|---|
| 2232670 | 1/1974 | Germany | 312/238 |
| 2350343 | 5/1974 | Germany | 312/238 |
| 2634924 | 2/1977 | Germany . | |
| 4325108 | 11/1992 | Japan | 312/238 |
| 91/03189 | 3/1991 | WIPO . | |

*Primary Examiner*—Peter M. Cuomo
*Assistant Examiner*—Gerald A. Anderson
*Attorney, Agent, or Firm*—Zarley, McKee, Thomte, Voorhees & Sease

[57] ABSTRACT

In a corner furnishing element, a displaceably held inner built-in part is displaceable from an inner position into a position accessible from outside through an opening of the corner furnishing element. For this purpose a lever is provided which has two arms. This lever is pivotable, the one arm being in operative connection to a track, which is pivotable together therewith about a vertical pivot axis after an outer built-in part has been pulled out of the corner furnishing element. The other arm is connected to the inner built-in part by means of a connecting rod. The lever is formed by a solid or hollow profile, which is bent in the middle area. This lever can thus be inexpensively produced. Moreover the one arm can be provided with bends by means of which the character of the displacement movement of the inner built-in part can be changed.

4 Claims, 5 Drawing Sheets

CORNER FURNISHING UNIT

BACKGROUND OF THE INVENTION

This invention concerns a corner furnishing element or unit comprising a frame with guides, and an outer built-in part that is disposed so that it can be pulled out of the frame by means of the guides. A pivot axis is provided at the guides. The outer built-in part, in a pulled-out state, is pivotable about the pivot axis. A track, which is pivotable together with the outer built-in part in its pulled-out state about a vertical pivot axis, creating an opening thereby, is also provided. The corner furnishing unit also has longitudinal guides, in which an inner built-in part is longitudinally displaceable, and a lever system which has a two-armed lever pivotably held in the frame and a connecting rod. One of the arms of the lever is in operative connection with the track and the other arm is connected to the connecting rod. The connecting rod is connected to the inner built-in part.

Such a lever system is known from the European patent EP 0 441 919. In the case of the device disclosed in said patent, the lever, which is pivotable about a fixed fulcrum, is made of two parts connected to each other. The one part, which forms the one arm of the lever, is of U-shaped profile, while the second part, which forms the other arm, has a flat profile. The two parts are connected together by welding or soldering. The U-shaped rod cooperates with the track, which can pivot together with this track about a vertical pivot axis in the pulled-out state of the outer built-in part. In so doing, a guide element fixed to this track, which preferably consists of a roller and which is moved on a circular path, and which is guided in the U-shaped rod, is displaced along this U-shaped profile, whereby the pivot movement of the lever is achieved.

Manufacture of this lever is time-consuming and relatively expensive. Furthermore the opening of the U-shaped profile, which serves as a guide for the roller, is directed upward since this lever is disposed in the corner furnishing element below the part which can be pivoted out and thus below the track. Consequently the risk of soiling of the guide surfaces of this U-profile is great, which can jeopardize optimal functioning. Risk of soiling results in particular when baskets of wire mesh are used as depository areas, as is becoming more and more common. It is therefore necessary to have these guide tracks periodically cleaned.

Also disadvantageous is that this lever system is not aesthetically appealing. This is once again of particular importance when, as already mentioned, wire mesh baskets are used as the depository areas in the built-in parts.

The object of the present invention consists in creating a lever system avoiding the drawbacks mentioned above, and which is especially simple and inexpensive to manufacture, having low risk of soiling and an improved aesthetic effect.

SUMMARY OF THE INVENTION

This object is attained, according to the invention, in that the lever, having two arms, is formed from at least one solid or hollow profile, bent in the middle portion and provided with a bearing element, which is disposed in a bearing part fixed to the frame, the lever is pivotable in a plane, which is essentially perpendicular to the vertical pivot axis, and said one arm of the lever is provided with at least one bend lying in said plane.

This lever is preferably obtained from a metal rod of solid profile having a circular cross-section, the two arms being obtained by bending this rod. This lever can thus be very simply manufactured.

By using a metal rod of solid profile for the manufacture of the lever, there is the advantageous possibility of very simply bending the one arm of the lever in the plane perpendicular to the vertical pivot axis. It is thereby possible to adjust the character of the movement of displacement undergone by the inner built-in part during the pivoting of the outer built-in part about the vertical pivot axis.

To this end the one arm can be advantageously bent such that the displacement of the inner built-in part is practically completed during a first range of pivoting out, and the inner built-in part practically stands still during the last range of pivoting out. A complete shift of the inner built-in part into the position accessible from outside can thereby be achieved in the case where the outer built-in part, for whatever reason, cannot be pivoted out by nearly 90°, without it being necessary to make changes in the disposing of the mounting points of the entire device.

A preferred embodiment of the invention consists in that the connection between track and lever is formed by a pin, which is held in the track pivotable about a pivot axis, and which is provided with a through hole through which the corresponding arm of the lever protrudes, whereby an optimal guiding is achieved in the simplest way.

To simplify assembly of the individual elements into a corner furnishing element, the pin has preferably snap elements so that it only has to be pressed into a corresponding bore of the track and is rotatably held therein.

Also serving to simplify assembly is the slot-shaped recess provided on the pin, which is designed in such a way that the corresponding arm of the lever can be pressed into the through hole through the slot-shaped recess, and is slidingly led therein, held by means of a snap effect.

An embodiment of the lever system according to the invention will be described more closely in the following, by way of example, with reference to the attached drawing.

Figure 1:
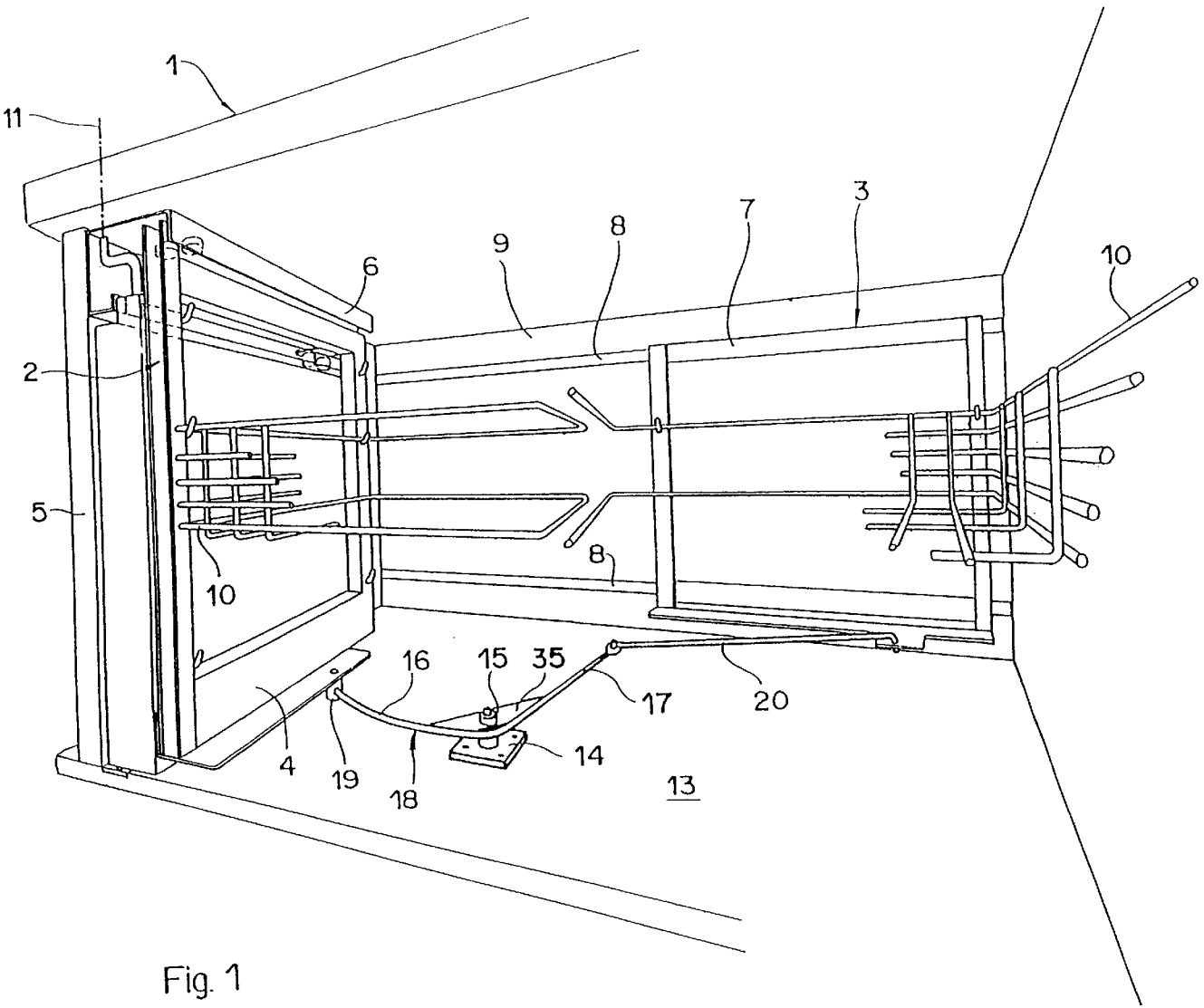
FIG. 1, a spatial representation of the interior of a corner furnishing element, the two built-in parts being shown schematically and only partially, the inner built-in part being situated in its inner position and the outer built-in part being in the pushed-in position.
Figure 2:
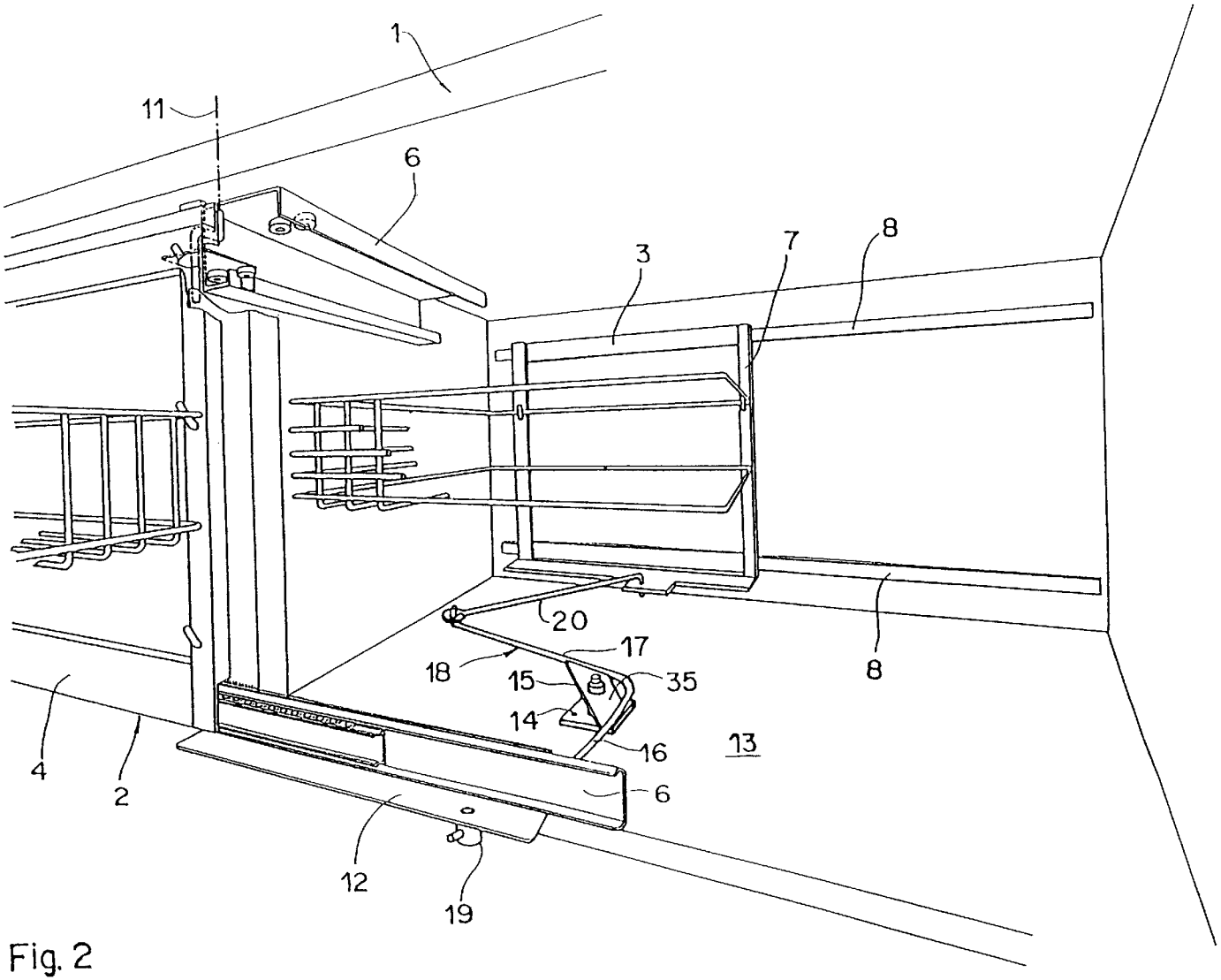
FIG. 2, a spatial representation according to FIG. 1, the outer built-in part being, however, in pivoted-out state and the inner built-in part in the position accessible from outside.

Disposed inside a corner furnishing element, as shown in FIGS. 1 and 2, is an outer built-in part 2 and an inner built-in part 3. The outer built-in part 2 consists of a vertically disposed frame 4, which is displaceably disposed in guides 6 provided on the side wall 5 of the corner furnishing element 1. Wire mesh baskets 10 can be hung on the frame 4 in a known way as depositories.

The inner built-in part 3 likewise consists of a vertically disposed frame 7, which is held displaceably in the longitudinal guides 8, which are provided in the area of the rear wall 9 of the corner furnishing element 1. Wire mesh baskets 10 can also be hung in this frame 7.

In the state shown in FIG. 1, the inner built-in part 3 is situated in its inner position, while the outer built-in part 2 is situated in the pushed-in position. To open the corner furnishing element 1, the outer built-in part 2 is completely pulled out. This part can then be pivoted out about a vertical pivot axis 11, as is shown in FIG. 2. The track 12, in which a part of the guide 6 for the frame 4 is held, thereby pivots along.

Mounted on the floor 13 of the corner furnishing element 1 is a bearing part 14, on which a bearing element 15 has been slipped on, to which the lever 18, consisting of two arms 16 and 17, is fastened. For this purpose, a cross-piece 35, on which the bearing element 15 is disposed, is preferably placed between the two arms 16 and 17. The lever 18 is pivotable in a plane which is perpendicular to the vertical pivot axis 11.

The one arm 16 is connected to the track 12 by means of a pin 19, which is pivotably held in the track 12, as will be described in the following. The other arm 17 is connected with a connecting rod 20, which itself is connected to the inner built-in part 3.

Upon pivoting out of the outer built-in part 2 about the vertical pivot axis 11, the pin 19 moves along the one arm 16 of the lever 18, whereby this lever itself is pivoted. During this pivoting out, the lever 18 causes, together with the connecting rod 20, the inner built-in part 3 to be shifted into a position accessible from outside, as is shown in FIG. 2.

Figure 3:
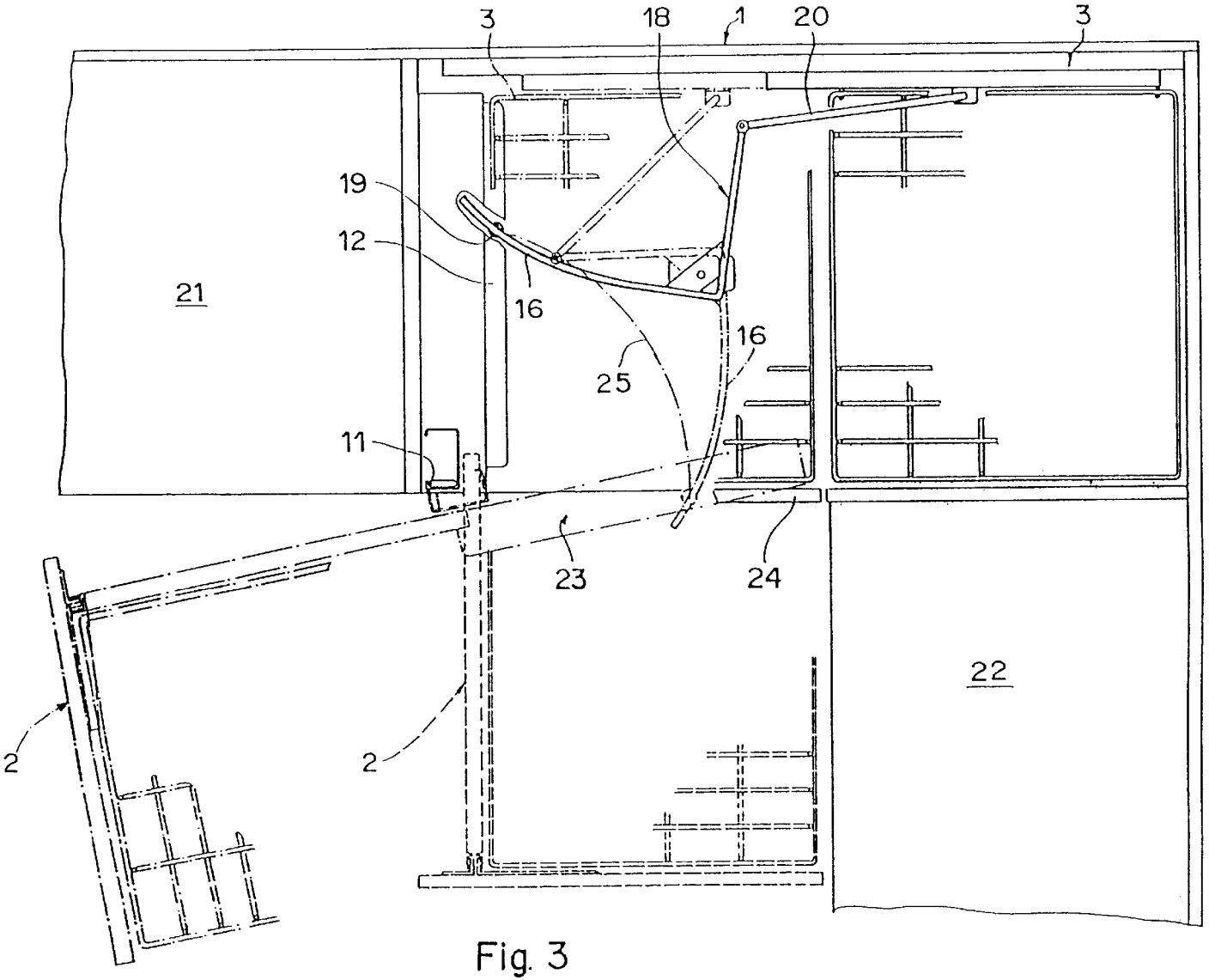
FIG. 3, a top plan view of the interior of a corner furnishing element according to FIGS. 1 and 2 with movements indicated schematically.

The whole course of movement can be seen better in FIG. 3. Here the corner furnishing element 1 is seen in the installed state, the furnishing elements 21 and 22 adjacent thereto being shown only schematically. In the closed state of the corner furnishing element 1, the inner built-in part 3 is situated in its inner position, as is indicated by the unbroken lines. The opening 23 of the corner furnishing element is hereby covered by the front element 24 provided on the outer built-in part 2. The lever 18 is likewise in the position indicated by unbroken lines.

To open the corner furnishing element, as already described, the outer built-in part 2 is brought into the pulled-out position, indicated by broken lines. During this pulling out step, the track 12 remains in its original position. In the completely pulled out position, the outer built-in part 2 can be pivoted about the vertical pivot axis 11, as is indicated by the lines of dots and dashes. During this pivoting of the outer built-in part 2, the track 12 also pivots. The pin 19 pivotably held on the track 12 hereby executes a movement along the circular path 25. The pin 19, in which the one arm 16 of the lever 18 is led, moves hereby along this arm 16, the lever 18 being pivoted about the bearing part 14 until it reaches the position indicated with lines of dots and dashes.

By means of the pivoting, the inner built-in part 3 is shifted into the area of the opening 23, the position of the inner built-in part being likewise indicated by lines of dots and dashes. The inner built-in part is thereby now accessible through the opening 23, opened up by the pivoting away of the outer built-in part 2.

As is particularly visible in FIG. 3, the one arm 16 of the lever has a bend. This bend is achieved by bending the rod, from which the arm 16 is formed, in the plane which is perpendicular to the vertical pivot axis 11, and toward the other arm 17. Thus a desired course of movement of the inner built-in part 3 can be achieved during the pivoting out of the outer built-in part 2, depending upon the bent shape of the arm 16.

Bending the arm 16 into the desired form is particularly easy to carry out if this arm, as is preferred, is formed by a metal rod of solid profile having a circular cross-section. Depending upon the bent shape which the arm 16 has, it is possible to optimize the character of the displacement movement of the inner built-in part 3 during pivoting of the outer built-in part 2 about the vertical pivot axis 11. It is not necessary thereby to change the mounting points or pivot points of the lever 18. This also simplifies in particular the assembly of the entire device.

Figure 4:
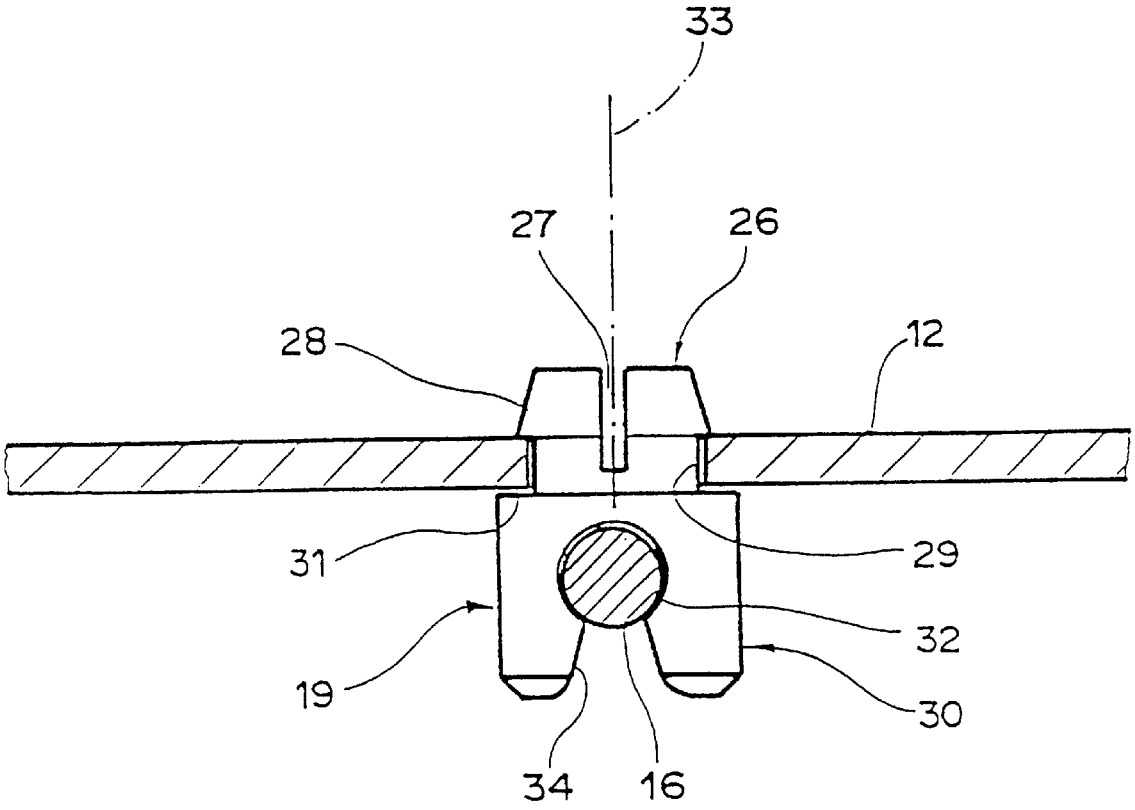
FIG. 4, a section through the pin inserted in the track.

The pin 19, via which the operative connection between the track 12 and the one arm 16 of the lever 18 is formed, has a first cylindrical part 26, as can be seen from FIG. 4. Provided in this part is a slot 27 running in transverse direction. Projections 28 are foreseen in the outer surface of the part 26. This part 26 of the pin 19 can be pressed into a bore 29 of the track 12, the projections 28 acting together with the slot 27 as snap elements, which keep the pin 19 in the track 12 pivotable about the pivot axis 33.

The part 30 adjacent to the cylindrical part 26 is likewise cylindrical, and has a larger diameter. The pin 19 is thereby supported on the track 12 by means of the shoulder 31 thus formed.

Provided in the part 30 is a through hole 32, which is directed at a right angle to the pivot axis 33 of the pin 19. The arm 16 of the lever 18 projects, and is led slideably, through this through hole. The part 30 of the pin 19 is provided with a slot-shaped recess from the end area remote from the track. This recess has a shape tapering from the outside, and runs into the through hole 32. The width in the area of the through hole 32 is smaller than the diameter of the arm 16. The arm 16 can be pressed through this slot-shaped recess 34, the part 30 of the pin 19 being elastically deformed until the arm 16 snaps into the through hole 32, and slideably led, is held therein. The assembly for connecting the lever 18 to the track 12 is thereby considerably simplified. The pin 19 is therefore preferably made of a correspondingly elastic plastic or other artificial material.

Figure 5:
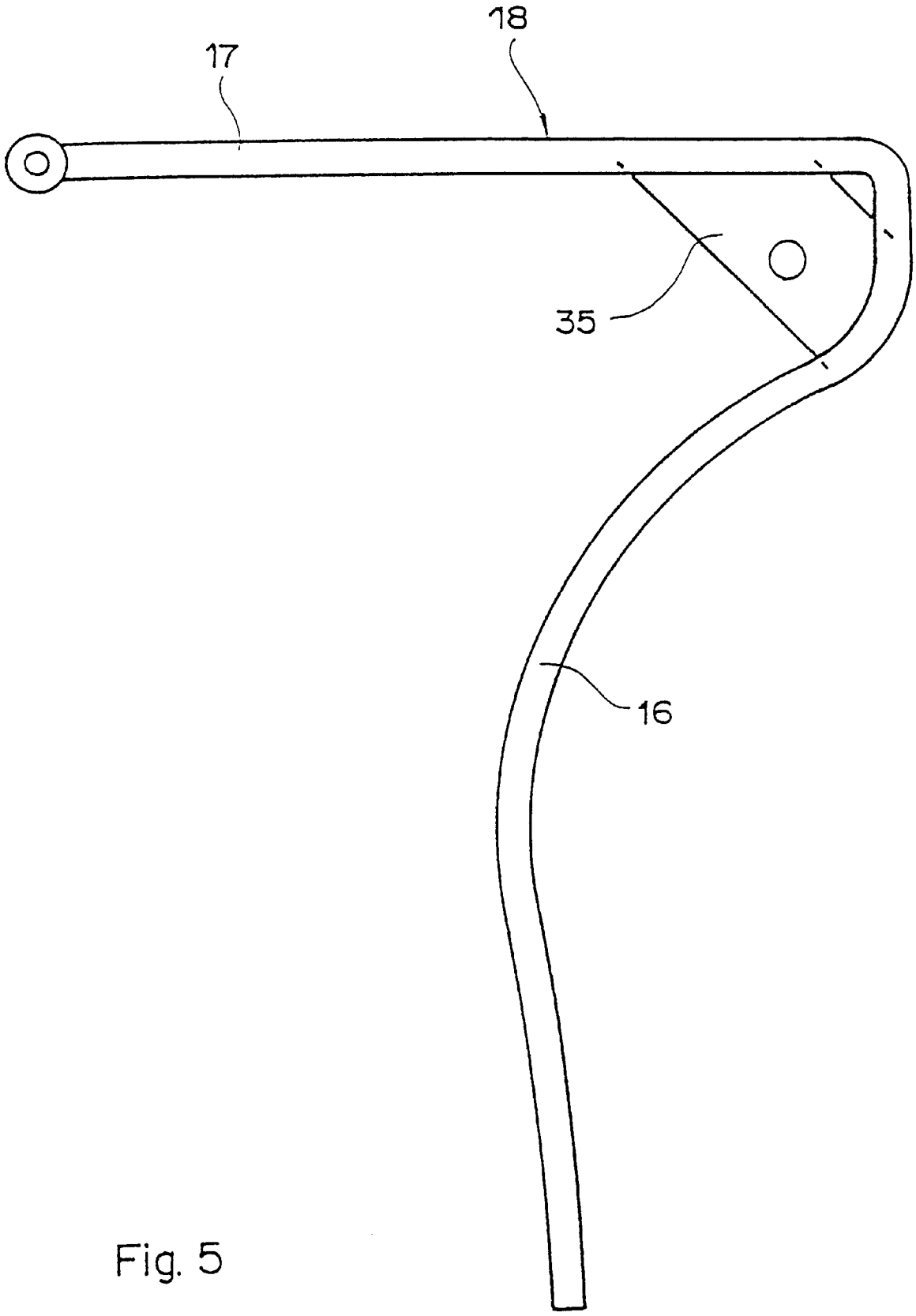
FIG. 5, a top plan view of a further embodiment of a lever.

In the case of the lever 18 shown in FIG. 5, one arm 16, which is in operative connection with the track 12, is bent such that the lever 18 almost completes its entire pivot in a first range of pivot of the outer built-in part 2 about the vertical pivot axis 11, and thus the inner built-in part 3 traverses the whole displacement path from the inner position into the position accessible from outside. In the final range of pivoting of the outer built-in part 2, the lever 18 and thus the inner built-in part 3 remain practically still. For this reason this lever 18 can be used for corner furnishing elements, in which the outer built-in part is pivotable by nearly 90°; it can also be used, however, when the outer built-in part is only pivotable in a limited way, for example by about 70°, without any adjustments of the lever system being necessary.

The function of the lever 18, as has been described in the foregoing, could be fulfilled by a cam disk. The costs of manufacturing such a cam disk, however, would be considerably higher than those for the lever.

This inventive lever system can be inexpensively manufactured. Moreover, owing to the possible bending of the arm 16, the possible uses are manifold without it being necessary to make any changes in the arrangement. The lever system is more aesthetically appealing than those previously known. The surfaces can be treated in a known way, contributing to an improved aesthetic effect. The risk of soiling and of excessive wear and tear on the individual elements is minimal; a lasting functioning of this system is ensured.

What is claimed is:

1. A corner furnishing unit, comprising:

a frame with first guides, an outer built-in part, disposed in the frame so that it can be pulled out through the guides to a pulled-out state, a pivotal connection between the frame and outer built-in part defining a pivot axis at the guides and about which the outer built-in part is pivotable in the pulled-out state, a track, which is pivotable about a vertical pivot axis together with the outer built-in part in the pulled-out state, longitudinal guides provided in the frame, on which longitudinal guides an inner built-in part is longitudinally displaceable, and a lever system, which comprises a two-armed lever pivotably held in the frame, and a connecting rod, and one of the arms of the lever is in operative connection with the track and the other arm is connected to the connecting rod, which is connected to the inner built-in part, wherein the two-armed lever is formed from a metal rod of solid profile, having a circular cross-section, which is bent in a middle portion, and is provided with a bearing element which is disposed on a crosspiece, the crosspiece being fastened to the arms enclosing an angle, the lever is pivotable in a plane which is essentially perpendicular to the vertical pivot axis, and said one arm of the lever comprises a further bend, lying in said plane, such that, in a first range of an outward pivoting of the outer built-in part, a displacement of the inner built-in part is substantially complete and a position accessible from an outside through an opening is practically reached, and in a final range of the outward pivoting of the outer built-in part, the inner built-in part stands practically still.

2. A corner furnishing unit, comprising:

a frame with first guides, an outer built-in part, disposed in the frame so that it can be pulled out through the guides to a pulled-out state, a pivotal connection between the frame and outer built-in part defining a pivot axis at the guides and about which the outer built-in part is pivotable in the pulled-out state, a track, which is pivotable about a vertical pivot axis together with the outer built-in part in the pulled-out state, longitudinal guides provided in the frame, on which longitudinal guides an inner built-in part is longitudinally displaceable, and a lever system, which comprises a two-armed lever pivotably held in the frame, and a connecting rod, and one of the arms of the lever is in operative connection with the track and the other arm is connected to the connecting rod, which is connected to the inner built-in part, wherein the two-armed lever is formed by at least one solid or hollow profile which is bent in a middle area and is provided with a bearing element which is disposed on a bearing part fastened to the frame, the lever is pivotable in a plane which is essentially perpendicular to the vertical pivot axis, and said one arm of the lever comprises a further bend, lying in said plane, such that, in a first range of an outward pivoting of the outer built-in part, a displacement of the inner built-in part is substantially complete and a position accessible from an outside through an opening is practically reached, and in a final range of the outward pivoting of the outer built-in part, the inner built-in part stands practically still, wherein the corner furnishing unit has an inner space, and a pin is held pivotable, in the track, about a pivot axis in an area projecting into the inner space of the corner furnishing unit, the pivot axis being essentially parallel to the vertical pivot axis, and the pin being provided with a through hole directed at a right angle to the pivot axis, said one arm of the two-armed lever protrudes through the through hole and is led by sliding, and which through hole corresponds essentially in shape to the profile of said one arm.

3. A corner furnishing unit according to claim 2, wherein the pin is made of plastic, is inserted in a corresponding bore of the track, and is pivotably held in the corresponding bore of the track by snap elements.

4. A corner furnishing unit according to claim 2, wherein the pin is provided with a slot-shaped recess which recess has a shape tapering from a surface of the pin to the through hole.

* * * * *

UNITED STATES PATENT AND TRADEMARK OFFICE

CERTIFICATE OF CORRECTION

PATENT NO. : 5,941,620
DATED : August 24, 1999
INVENTOR(S) : Peter Weber

It is certified that error appears in the above-identified patent and that said Letters Patent is hereby corrected as shown below:

In Column 2, line 53, please insert the following heading:

DETAILED DESCRIPTION OF THE PREFERRED EMBODIMENT.

Signed and Sealed this

Ninth Day of May, 2000

*Attest:*

Q. TODD DICKINSON

*Attesting Officer*

*Director of Patents and Trademarks*